US006386845B1

(12) United States Patent
Bedard

(10) Patent No.: US 6,386,845 B1
(45) Date of Patent: May 14, 2002

(54) AIR BLOWER APPARATUS

(76) Inventor: Paul Bedard, 1120 SE. 7th Ave., Pompano Beach, FL (US) 33060

( * ) Notice: Subject to any disclaimer, the term of this patent is extended or adjusted under 35 U.S.C. 154(b) by 0 days.

(21) Appl. No.: 09/645,151

(22) Filed: Aug. 24, 2000

Related U.S. Application Data

(60) Provisional application No. 60/150,428, filed on Aug. 24, 1999.

(51) Int. Cl.[7] ..... F04B 17/00; F04B 35/04

(52) U.S. Cl. ..... 417/423.15; 417/363

(58) Field of Search ..... 417/410.1, 423.1, 417/423.7, 423.15, 423.11, 423.14, 424.2, 363

(56) References Cited

U.S. PATENT DOCUMENTS 3,801,229 A * 4/1974 Henderson ..... 417/359
4,810,175 A * 3/1989 Jezorski ..... 417/423.12
6,155,801 A * 12/2000 Elnar ..... 417/363

* cited by examiner

*Primary Examiner*—Teresa Walberg
*Assistant Examiner*—Thor Campbell
(74) *Attorney, Agent, or Firm*—Richard M. Saccocio

(57) ABSTRACT

An encased air blower (10) includes a motor and fan assembly (21) which is connected to the casing (11) of the air blower (10) by a combination mounting and sealing member (22). The unique mounting and sealing member (22) provides a positive seal between the suction (12) and pressure (13) sides of the air blower casing (11). The unique mounting and sealing member (22) further serves to acoustically isolate the motor and fan assembly (21) from the casing (11) and thereby significantly reduces the operational noise level of the air blower.

15 Claims, 6 Drawing Sheets

AIR BLOWER APPARATUS

CROSS REFERENCE TO RELATED APPLICATIONS

This application is based on provisional application Serial No. 60/150,428 filed Aug. 24, 1999.

BACKGROUND OF THE INVENTION

1. Field of the Invention

This invention relates in general to the field of air blower motor assemblies and in particular to a mounting and sealing arrangement for an air blower motor and fan assembly designed for high output, leak free and quiet operation.

2. Description of the Prior Art

An air blower, in its simplest version is a fan which moves or blows air in a forward direction. A fan consists of a motor having blades which extend perpendicular from the shaft of the motor and have a bi-directional twist along their length. By reversing the direction of rotation of the motor, the fan would blow air in a backward direction. As an alternative, the pitch of the fan blades may be used to set and change the direction of the moving air. Another type of prior art air blower uses impeller blades which draw air in from a center opening, forces it outward, and is then channeled in a desired direction. Such prior fans find use in cooling electrical components cooling the motor itself, in air conditioners to liquefy the compressed gas, in automobiles to blow air past radiators, and many other like applications.

In the event that the moving air is desired to be more directed, an encasement is placed around the fan blades and the motor. An air inlet is provided at one end of the casing and an air outlet is provided at the other end of the casing. A tube or hose is then connected to the air outlet, which allows the air to be directed to a particular location or in a more concentrated direction. For example, a leaf or grass blower is one such application. A vacuum cleaner is another example, but the direction of airflow is reversed. In these shrouded or encased fan applications, radial impeller vanes are generally used rather than fan blades. Radial vanes provide a smaller overall package and allow for higher flow rates and higher pressures.

In an encased blower arrangement and where the airflow is axial, a seal is advantageously used to separate the inlet side of the casement from the outlet side. Without a dividing seal, the air can circulate within the casing rather than being blown out of the outlet part. The air would simply take the path of least resistance. Thus, in practice, in order to maximize the efficiency of an air blower, it is desirable to have the most effective seal possible, which in certain applications takes the form of making the casing in two parts, a front portion, and a back portion. The seal is placed between two portions of the casing and in some manner is attached to the motor and fan assembly within the casing.

In a low volume, low pressure encased fan arrangement, a simple seal is all that is necessary to maintain the separation of the pressure side of the casing from the vacuum or suction side of the casing. However, when a large volume of air is required to be blown or moved within the casing, and or high pressure is required, the seal becomes problematic. Moreover, when it is necessary or desirable to minimize the size of the casing, the sealing becomes even more problematic because of the large pressure differential that results between the suction side and the pressure side within the casing. The pressure differential tends to unseat the seal rendering it ineffective or inefficient. This prior art problem is solved by the present invention.

Another problem present in the prior art air blower assemblies is the existence of noise when the unit is in operation. Moving large volumes of relatively high pressure air creates substantial noise. The causal factor being the difficulty in isolating the fan and motor within the casing from the casing itself. The present invention also overcomes this prior art problem.

SUMMARY OF THE INVENTION

The present invention accomplishes the above-stated objectives as well as others, as may be determined by a fair reading and interpretation of the entire specification herein, which comprises an air blower having a combination seal and motor mount. The seal effectively seals between casing halves and between the suction and pressure sides of the motor and the fan assembly. Moreover, the seal serves to acoustically isolate the motor and fan assembly from the casing and substantially reduces the noise associated with the air blower.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
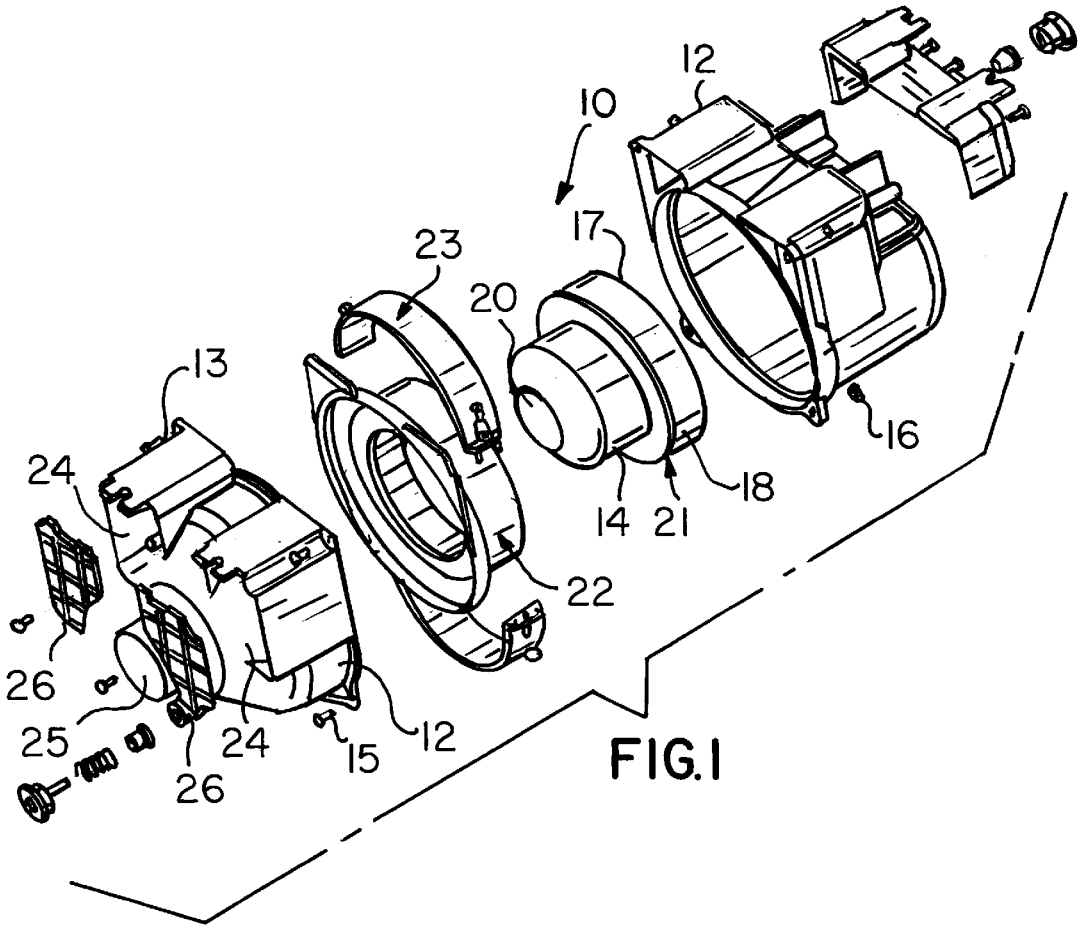
FIG. 1 is an exploded isometric rendering of one embodiment of the present invention as applied to an encased air blower.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Reference is now made to the drawings, wherein like characteristics and features of the present invention shown in the various figures are designated by the same reference numerals.

Reference is particularly made to FIG. 1, which is an exploded isometric rendering of one embodiment of the present invention as applied to an encased air blower. FIG. 1 illustrates an air blower assembly, which, for example, can be used with a hot water spa or hot tub. In this type of application the air blower is remotely located relative to the spa and is connected thereto by one or more conduits which direct the air from the blower outlet to the nozzles of the spa or hot tub. Since the present invention is only concerned with the air blower, the spa and conduits are not shown. The invention, however, is not limited to spa air blowers. The invention herein may be used with any air blower having integral blades and a motor.

The casing 11 of the air blower 10 is made up of two halves 12 and 13. Casing half 12 is termed the "suction half" because it draws or sucks low pressure air into the inlet of the air blower. A negative pressure exists within this portion 12 of the casing 11. Casing half 13 comprises the "pressure portion" because a positive pressure exists therewithin due to the pressuring action of the motor and fan. Casing half 13 includes an air outlet port and an air inlet port which are both located on the front face of the casing half 13 of the casing 11.

A motor 14 is fixedly positioned within casing 11 when the two halves 12 and 13 are fastened together, such as by bolts 15 and nuts 16. A fan or impeller 17 having, for example, radial vanes is attached to the shaft of motor 14 such that the impeller 17 rotates with the motor shaft when electricity is applied to the motor 14. For purposes of this description, the words "fan" and "impeller" are interchangeable. A shroud 18 surrounds the impeller blades in order to direct the flow of air into the center inlet 19 (see FIG. 2) and out of the outlet 20 of the motor and impeller assembly 21.

In the illustrated embodiment 10, a combination mounting and sealing member 22 is used to mount the motor and impeller assembly 21 within and to the casing 11 and to seal between the suction 12 and pressure 13 halves of casing 11. In the embodiment 10 of FIG. 1, the mounting and sealing member 22 further serves to acoustically isolate the motor and impeller assembly 21 from the casing 11 to lessen the noise produced by the motor and impeller assembly 21 and the air being blown therethrough. A clamp 23 is used to attach the motor and impeller assembly 21 to the mounting and sealing member 22.

Still referring to FIG. 1, the pressure half 13 of casing 11 includes air inlet openings 24 and an air outlet opening 25 (as noted above). The inlet openings 24 can be covered by filters or screens 26 to prevent unwanted objects from entering the air blower 10. The casing halves 12 and 13 include internal ducting to allow the inlet air and the outlet to enter and exit respectively from the front of the pressure half 12 of casing 11 as is more fully explained hereinafter. This arrangement has the advantage of having only the front portion of casing 11 exposed when the air blower 10 is mounted for use.

Figure 2:
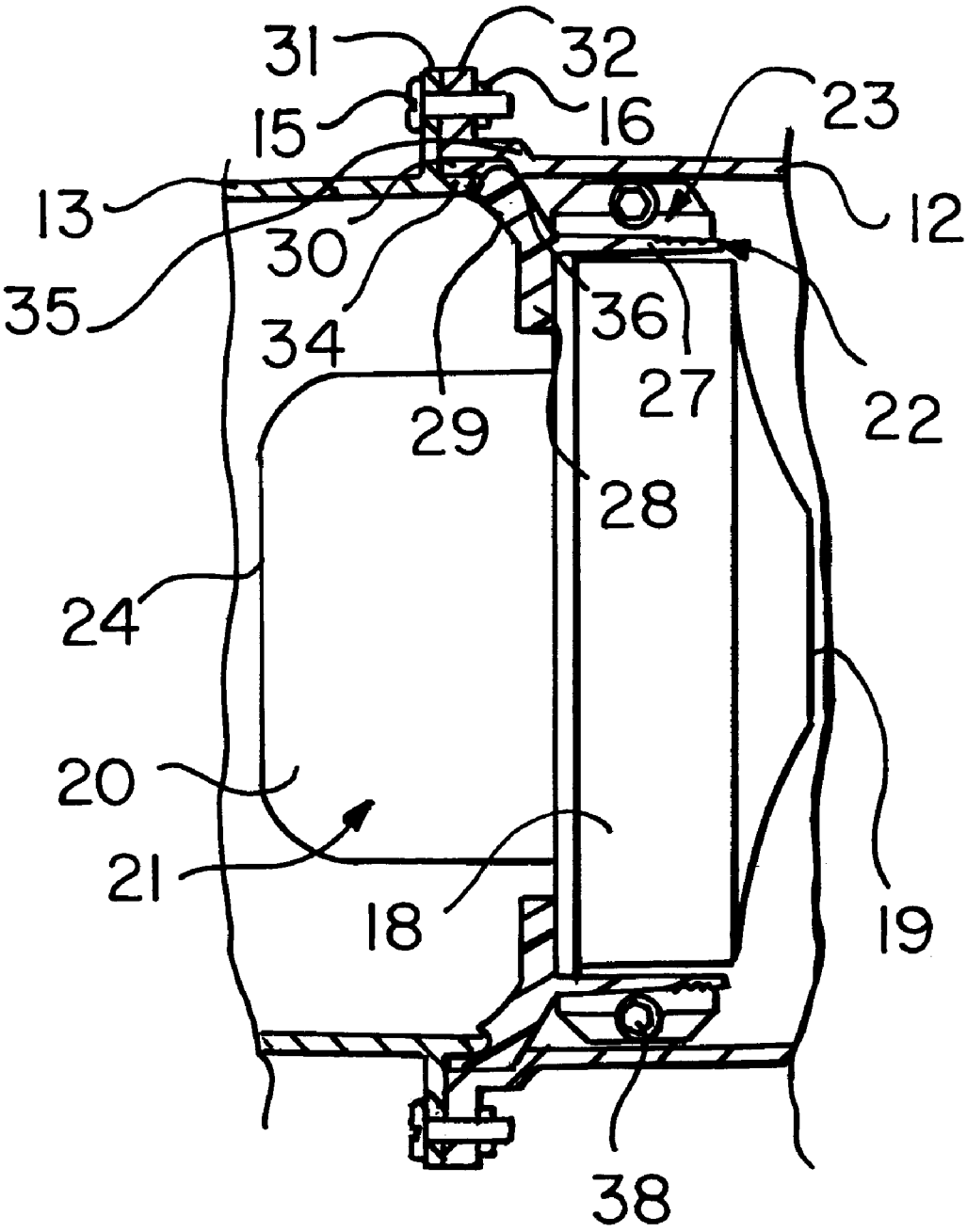
FIG. 2 is a partial cross-sectional view of the motor and impeller assembly being mounted and sealed within a casing of the present invention.

FIG. 2 illustrates a partial cross-sectional view of the motor and impeller assembly 21 being mounted and sealed within casing 11, as provided by the present invention. In this view, the unique configuration of the mounting and sealing member 22 and the mating portions of the casing halves 12 and 13 are shown. Also seen is the unique method and apparatus to mount and acoustically isolate the motor and impeller assembly 21.

Mounting and sealing member 22 is preferably made from a flexible PVC material. Mounting and sealing member 22 comprises a first cylindrical portion 27 is configured to closely fit around the outer circumference of the shroud 18 of the motor and impeller assembly 21. An annular portion 28 extends inward from the high pressure end of cylindrical portion 27. A flat portion of the shroud 18 fits up against the inside surface of annular portion 28 so as to position the axial location of the motor and impeller assembly 21 relative to the mounting and sealing member 22 and to enhance sealing.

An angled portion 29 extends outward from the outside corner of cylindrical portion 27 and annular portion 28 and terminates in a second cylindrical portion 30. The second cylindrical portion 30 is configured to provide for positioning the mounting and sealing member 22 between interconnecting portions of the casing halves 12 and 13 and thereby fix the location of the motor impeller assembly 21 within an relative to the casing 11. In this regard, the configuration of the flanges 31 and 32 of casing halves 11 and 12, respectively, provide an annulus within which the second cylindrical portion 30 is positioned.

Flanges 31 and 32 are further configured to apply inline forces to the angled portion 29 of mounting and sealing member 22 when fasteners 15 and 16 are tightened to connect casing halves 12 and 13. The inline forces are applied to the angled portion 29 by the cylindrical end 34 of casing half 11 and the angled portion 35 of casing half 12. When applied, the equal and opposite inline forces compress the angled portion 29 of the mounting and sealing member 22 and thereby provide a first seal between the pressure side and the suction side of casing 11. In order to enhance the inline sealing forces, an annular cutout or groove 36 is provided on the pressure side of the angled portion 29 of the mounting and sealing member 22. As shown in FIG. 2, the extending end 34 of casing half 11 fits within the groove 36.

A second seal is provided by the present invention between the pressure and suction sides of the motor and impeller assembly 21. The second seal is applied to the shroud 18 of the motor and impeller assembly 21 and is effectuated by the clamping force provided by clamp 37 which extends around the outside of cylindrical portion 27 of mounting and sealing member 22, and which compresses portion 27 into sealing contact with the outer circumference of shroud 18. In the embodiment shown, clamp 37 is comprises of two semicircular halves joined together by fasteners 38. Of course, a single piece clamp having one fastening point can also be used. The annular portion 28 of mounting and sealing member 22 serves to further enhance the seal between the casing halves 12 and 13. The higher pressure within casing half 11 is advantageously used to act upon the exposed surface of annular portion 28 to press and therefore seal, the annular portion 28 against the flat mating surface of the shroud 18.

Figure 3:
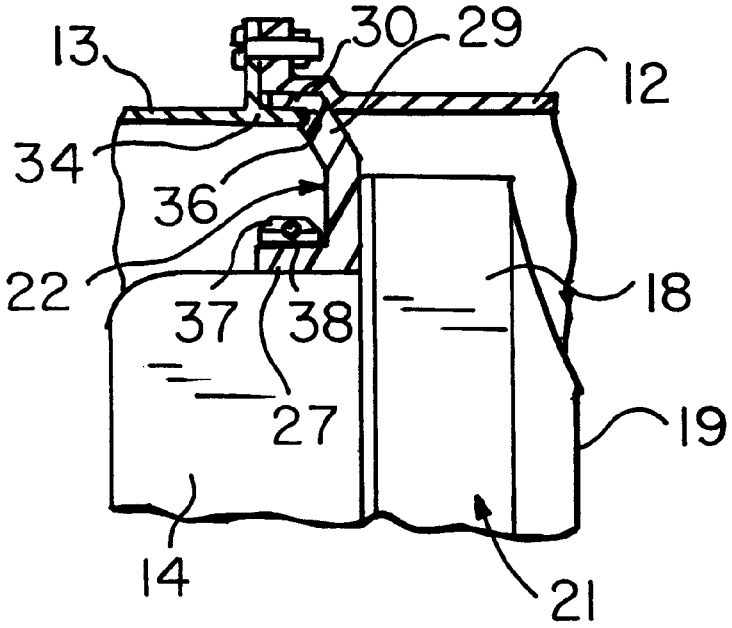
FIG. 3 is a partial cross section of a slightly different embodiment of the mounting and sealing member of the present invention.

An alternative to the embodiment of FIG. 2 is shown in FIG. 3. FIG. 3 shows a partial cross section of a slightly different embodiment of the mounting and sealing member 22. The cylindrical portion 27 of mounting and sealing member 22 is used to encircle the motor 14 of the motor and impeller assembly 21 and is sealing clamped therearound by clamp 37, as shown in FIG. 3.

Figure 4:
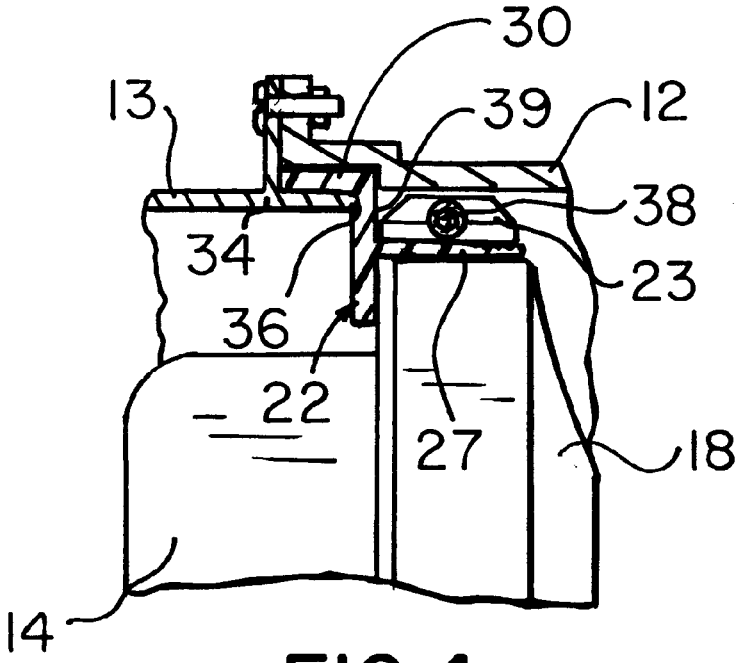
FIG. 4 is a partial cross-sectional view of another embodiment of the present invention.

FIG. 4 illustrates a partial cross-sectional view of another embodiment of the present invention. In this embodiment, the angled portion 29 of the mounting and sealing member 22 is eliminated and replaced by a non-angled annular portion 39.

Figure 5:
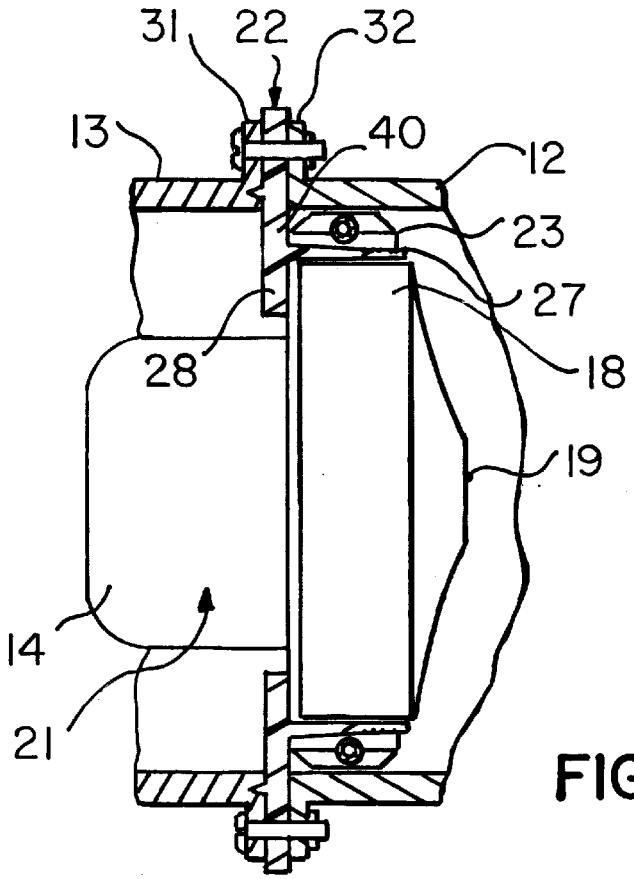
FIG. 5 is a partial cross section of yet another embodiment of the present invention.

FIG. 5 illustrates a partial cross section of yet another embodiment of the present invention. In this embodiment slightly different versions of the casing halves 12 and 13 and mounting and sealing member 22 are used. Mounting and sealing member 22 comprises the same cylindrical portion 27 and the same annular portion 28 of the embodiment of FIG. 2 such that the cylindrical portion 27 again is sealingly clamped around the shroud 18 and the annular portion again sealingly fits up against the shroud 18. However, a second annular portion 40 is positioned and compressed between the differently configured flanges 31 and 32.

In accordance with the various embodiments of the mounting and sealing member 22 described and shown above, it is apparent that even other differently configured flanges and seal portions can be readily envisioned by one skilled in the art which, of course, are intended to be included within the scope of the present invention.

Figure 6:
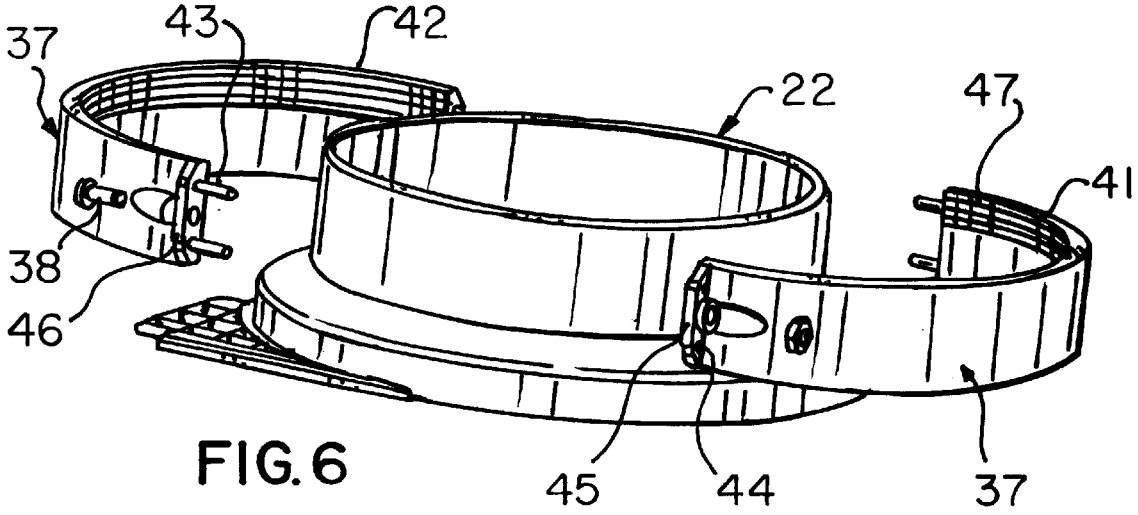
FIG. 6 is an expanded isometric illustration of the clamp securing the mounting and sealing member to the motor and impeller assembly of the present invention.

FIG. 6 illustrates an expanded isometric illustration of the clamp 23 securing the mounting and sealing member 22 to the motor and impeller assembly 21. In this view, the clamp 23 is seen to be made up of two halves 41 and 42; however, a's noted above, a single piece clamp can also be used. In order to assure proper connection of the two halves to each other, alignment pins 43, and holes 44 are provided in opposite sides of the flange portions 45 and 46 of the clamp halves. Fasteners 38 are then used to attach the two halves 41 and 42. One or more ribs 47 are provided along the inside circumference of the clamp halves 41 and 42, which ribs 47 extend slightly out from the inner circumference of clamp halves 41 and 42. Ribs 47 provide distinct pressure points against mounting and sealing member 22 when clamp 23 is tightened in order to enhance the positive seal against the motor and impeller assembly 21.

Figure 7:
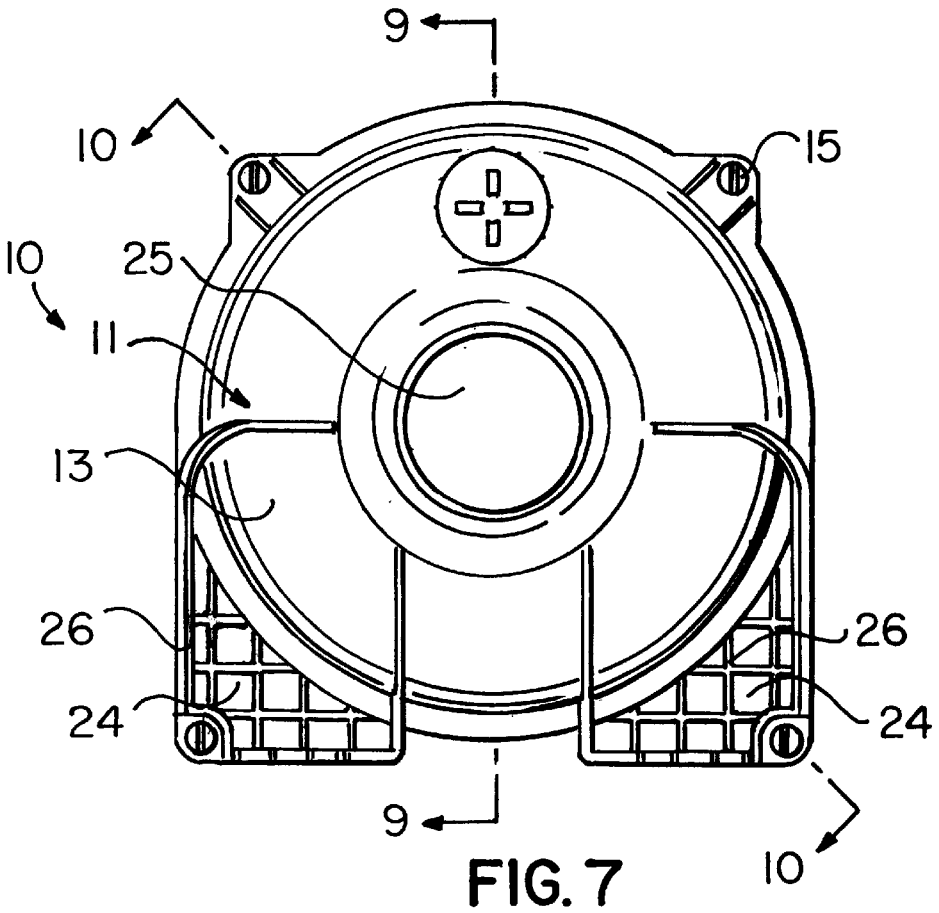
FIG. 7 is a front plan view of the casing of the present invention.
Figure 8:
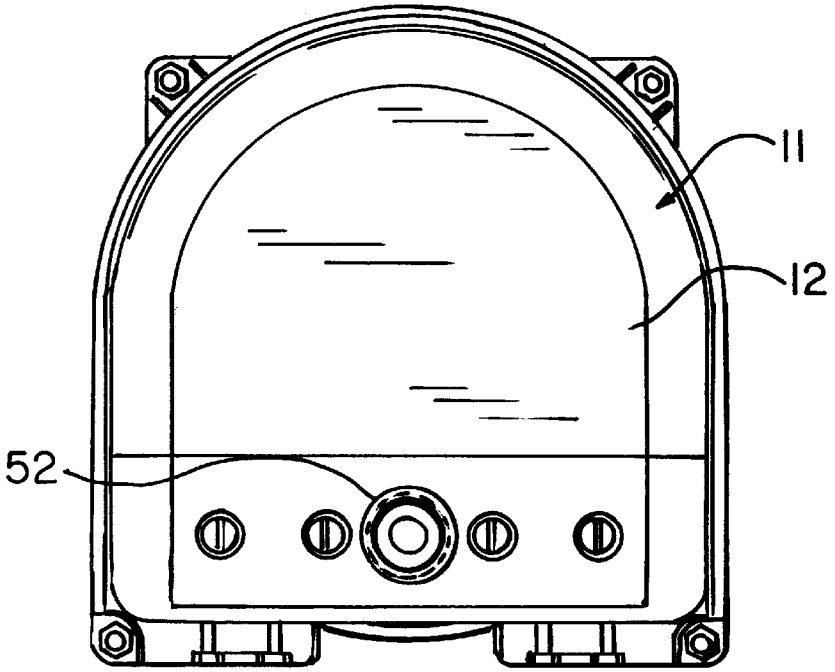
FIG. 8 is a back plan view of the casing of the present invention.
Figure 9:
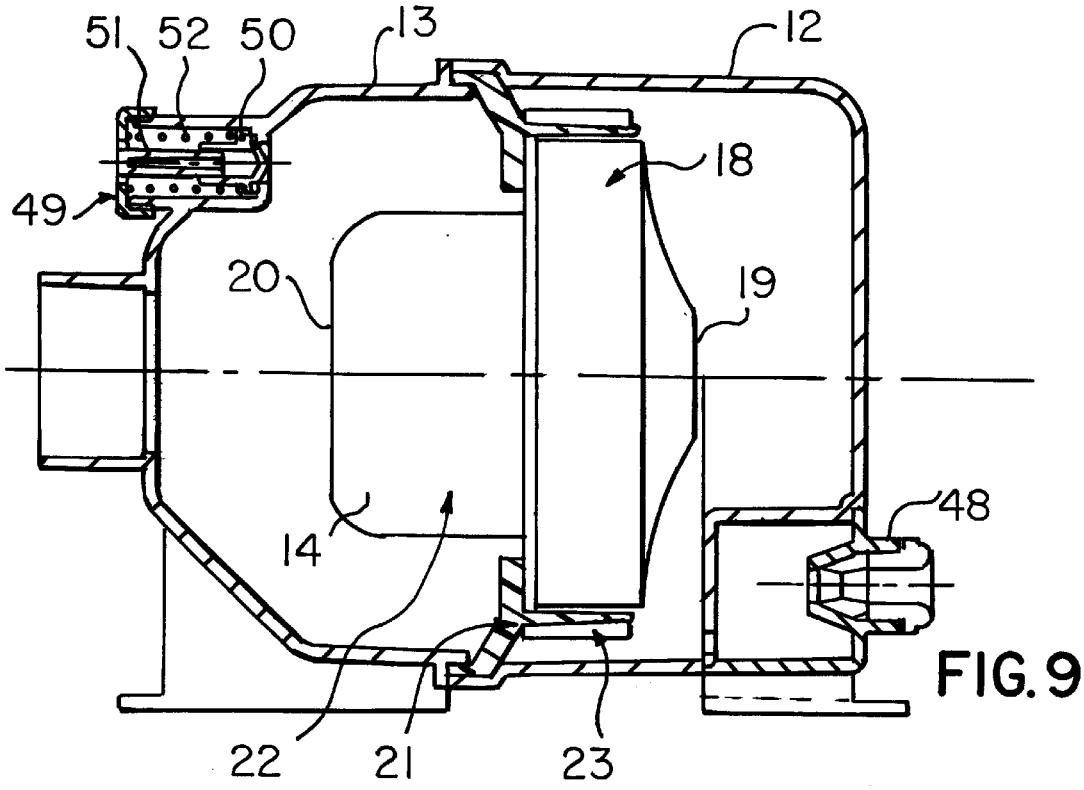
FIG. 9 is a cross-sectional view taken along the line 9—9 of FIG. 7 of the present invention; and, FIG. 10 is a cross-sectional view taken along the line 10—10 of FIG. 7 of the present invention.
Figure 10:
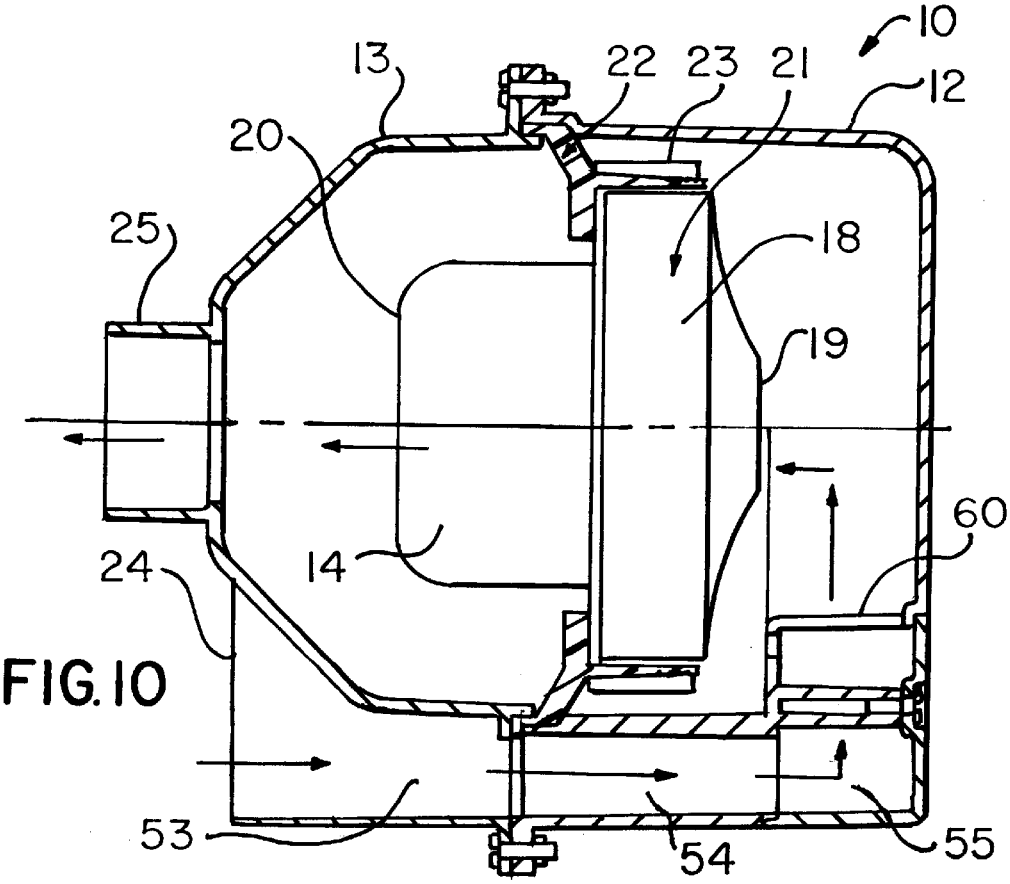

Details of the construction of the casing 11 are shown in FIGS. 7–10. FIG. 7 is a front plan view of casing 11. FIG. 8 is a back plan view of the casing 11. FIG. 9 is a cross-sectional view taken along the line 9—9 of FIG. 7. FIG. 10 is a cross-sectional view taken along the line 10—10 of FIG. 7.

The frontal view of the air blower apparatus 10 shows the air outlet 25 at the center of the casing 11. The air inlet ports 26 are located at the bottom corners of the casing 11.

As previously described, both the air inlet and air outlet ports 25 and 26 are located on the same front side of the air blower apparatus 10. The fasteners 15 used to secure the casing halves 12 and 13 are also shown in this view. FIG. 8 illustrates the substantially closed side of the back of the air blower apparatus 10. In this view, an electrical connector 52 is seen to be provided to connect electrical power to the air blower apparatus 10.

FIG. 9 is similar to FIG. 2 in that it shows the casing halves 12 and 13 with the mounting and sealing member 21 being interconnected between the casing halves 12 and 13. FIG. 9 further illustrates the electrical connector 48, which is integrally formed with casing half 12. A pressure relief valve 49 is provided on the high pressure casing half 13 to limit the positive pressure within casing half 13. Pressure relief valve 49 comprises a valve seat 50, a tapered needle 51 which cooperates with valve seat 50, and a spring 52. A desired pressure setting of valve 49 is obtained by the amount of force the spring 52 applies to the needle 51. Changing the spring force changes the pressure relief setting. This may be accomplished in any number of the ways known to one skilled in the art.

The air flow through the air blower apparatus 10 is generally by the unnumbered arrows shown in FIG. 10. The air enters through inlet openings 24 and proceeds through a channel 53 which is isolated from the inside of casing half 13 and is provided at the bottom corners of the air blower apparatus 10. An aligned channel 54 is provided in casing half 12 which is isolated from the inside of casing half 12. A flow direction chamber 55 is provided at the outlet of channel 54, which allows the air to be introduced into the suction side of impeller 18. Openings 60 are provided in a wall of chamber 59 to allow the air to exit from channel 58 and enter casing half 12. This arrangement eliminates the need for the suction air to be introduced through openings in the back of the air blower apparatus 10. This feature simplifies the actual mounting of the air blower apparatus to a structure in that air from only one direction needs to be considered in designing the mounting arrangement While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved.

I claim as my invention:

1. Air blower apparatus, comprising:

a casing comprising a first half and a second half configured to be removably connected to each other;

a motor and impeller assembly;

a circular clamp; and a combination mounting and sealing member sealingly attached to said motor and impeller assembly by said clamp and sealing connected between said first and second halves of said casing.

2. The air blower apparatus of claim 1, inlcuidng an air inlet opening and an air outlet opening, said inlet and outlet openings being lcoated on one of said casing halves.

3. The air blower apparatus of claim 2, wherein said casing halves include aligned air flow channels, said aligned air flow channels being connected to said air inlet openings.

4. The air blower apparatus of claim 1, wherein said mounting and sealing member includes a first cylindrical portion within which said motor and impeller assembly is sealing positioned, said clamp being positioned around an outer circumference of said first cylindrical portion.

5. The air blower apparatus of claim 4, wherein said mounting and sealing member includes a second cylindrical portion which is sealingly positioned within an annulus formed at a junction of said first casing half and said second casing half.

6. The air blower apparatus of claim 4, wherein said motor and impeller assembly includes a shroud around an impeller portion thereof; said first cylindrical portion of said mounting and sealing member encircling said shroud around said impeller portion.

7. The air blower apparatus of claim 4, wherein said first cylindrical portion of said mounting and sealing member encircles a motor portion of said motor and impeller assembly.

8. The air blower apparatus of claim 5, wherein said mounting and sealing member includes an angled portion interposed between said first and second cylindrical portions.

9. The air blower apparatus of claim 5, wherein said mounting and sealing member includes an annular portion extending inwarad from said first cylindrical portion, said annular portion fitting up against an annular surface of said shroud.

10. The air blower apparatus of claim 8, wherein one of said casing halves includes an angled portion configured to fit against said angled portion of said mounting and sealing member.

11. The air blower apparatus of claim 8, wherein one of said casing halves includes an extending cylndrical portion which fits up against said angled portion of said mounting and sealing member.

12. The air blower appratus of claim 11, wherein said angled portion of said mounting and sealing member includes a groove within which said extending cylindrical portion of one of said casing halves fits therewithin.

13. The air blower apparatus of claim 5, wherein said mounting and sealing member includes a first annular poriton extending between said first and said second cylindrical portions.

14. The air blower apparatus fo claim 13, including a second annular portion of said mounting and sealing member extending inward from said first cylindrical portion, said motor and impeller assembly including a shroud around an impeller portion thereof, said second annular portion of said mounting and sealing member fitting up against a flat surface of said shoud.

15. The air blower apparatus of claim 1 including a pressure relief valve associated with one of said casing halves.

* * * * *